United States Patent [19]

Tansley et al.

[11] Patent Number: 4,948,018

[45] Date of Patent: Aug. 14, 1990

[54] NOZZLES

[75] Inventors: Robert W. Tansley, Warwickshire; Andrew C. Bentley, Banbury, both of United Kingdom

[73] Assignee: General Foods, Ltd., Oxon, England

[21] Appl. No.: 324,352

[22] Filed: Mar. 15, 1989

[30] Foreign Application Priority Data

Mar. 21, 1988 [GB] United Kingdom ..... 8806667

[51] Int. Cl.[5] ..... B67B 7/24

[52] U.S. Cl. ..... 222/541; 222/81; 222/107; 215/250

[58] Field of Search ..... 222/80, 81, 107, 153, 222/541, 542, 420, 421, 566; 215/250

[56] References Cited

U.S. PATENT DOCUMENTS

| | | | |
|---|---|---|---|
| 1,854,451 | 4/1932 | Cooney | 222/542 |
| 2,682,974 | 7/1954 | Smith | 222/107 |
| 2,932,436 | 4/1960 | Dobbins | 222/541 |
| 4,750,642 | 6/1988 | Eckstein et al. | 222/81 |
| 4,792,061 | 12/1988 | Nishida | 222/107 |
| 4,844,917 | 7/1989 | De Lorimere | 222/107 |

*Primary Examiner*—Michael S. Huppert
*Assistant Examiner*—Kenneth Noland
*Attorney, Agent, or Firm*—Linn I. Grim

[57] ABSTRACT

A sealed beverage package containing one or more beverage preparation ingredients and being formed from substantially air- and water-impermeable materials has an outlet nozzle with an outlet aperture sealed by a rupturable seal and a bore formed therein, the width or diameter of the outlet aperture, D, and the length of the bore of the nozzle, L, being related by the equation:

$$L \geqq D/2$$

3 Claims, 2 Drawing Sheets

NOZZLES

Figure 1:
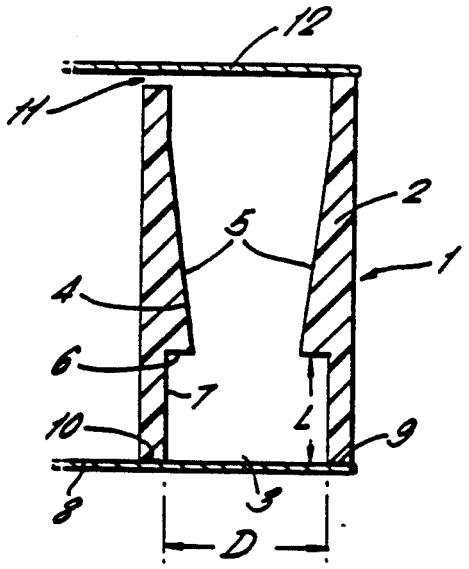

The present invention relates to nozzles and, in particular, to nozzles which form the outlet for beverage packages containing one or more beverage ingredients.

It has previously been proposed to seal fresh roast and ground coffee, or tea leaves, in individual air-impermeable packages.

For example, cartridges or capsules containing compacted roast and ground coffee are known for use in certain coffee making machines which are generally termed "espresso" machines. In the production of coffee using these machines the coffee cartridge is placed in a brewing chamber and hot water is generally caused to pass under pressure through the cartridge, thereby extracting the aromatic coffee constituents from the ground coffee and producing a coffee beverage. An outlet may be formed in the capsule merely by puncturing the capsule material. The beverage is collected beneath the outlet in a cup of other receptacle, but the rather random and jagged nature of the outlet formed in the capsule causes the beverage to sputter and splash as it is directed into the cup or receptacle.

Another type of beverage package is disclosed in British Patent Specification No. 2121762. This beverage package comprises a planar sachet of an air-and water-impermeable material which includes a filter material therein. The sachet has an inlet nozzle formed in sealing engagement with the sachet for the introduction of water into the sachet. In use of the sachet an outlet is formed therein, for example by cutting the bottom of the sachet open, or by tearing off a tear strip or peeling off a peel strip to create the outlet. The outlet formed in this package is also accompanied by the disadvantage that the beverage tends to sputter and splash.

We have now developed a beverage package which has an outlet nozzle which does not suffer from the above disadvantages and which is adapted so that a stream of the beverage is directed into an appropriate receptacle positioned beneath the outlet nozzle.

Accordingly, the present invention provides a sealed beverage package containing one or more beverage preparation ingredients and being formed from substantially air- and water-impermeable materials, the said package having a nozzle formed therein which comprises an outlet aperture and a body, the body having a throat portion which terminates in a shoulder and a bore which extends from the shoulder to the outlet aperture, the throat portion having side walls which converge at least along part of the length thereof and the outlet aperture being sealed by a rupturable seal, the width of diameter of the outlet aperture, D, and the length of the bore of the nozzle, L, being related by the following equation:

$$L \geqq D/2$$

The bore of the nozzle is preferably round and it will be appreciated that the outlet aperture will then also be round.

The relationship between the width or diameter of the outlet aperture, D, and the length of the bore of the nozzle, L, is important because when the outlet aperture is covered by a rupturable material and the seal over the outlet aperture is broken the ruptured sealing material is folded back into the bore. This arrangement prevents the edge of the foil from contacting the stream of the beverage as it emerges from the throat of the nozzle and thus prevents sputtering or splashing of the beverage. The converging throat of the nozzle channels or funnels the beverage into a jet which is thereby readily collected in a receptacle placed beneath the outlet aperture. It is preferred that the walls of the throat of the nozzle should converge at an angle of at least 5° to the vertical, preferably at an angle of 15° to 30° to the vertical.

it is also preferred that the diameter of the throat at the point where it terminates in the shoulder is about one half of the width or diameter of the outlet aperture.

The throat portion of the body of the outlet nozzle may have walls which converge along all of the length thereof and terminate in the shoulder. It may, however, be preferred, in some instances, for the walls of the throat portion to converge only along a part of the length thereof, the converging portion then joining a bore which terminates in the shoulder.

At the point where the shoulder joins the throat portion a drip lip may be provided to assist in channeling the beverage formed into a stream for collection in an appropriate receptacle.

The outlet aperture of the package is preferably sealed by a rupturable seal of a material which has appropriate deadfold characteristics so that on rupturing the seal to form an outlet from the package the material will remain folded in the bore of the nozzle. Appropriate materials for the formation of the seal are aluminium foil or a laminated material. Specific examples of materials which can be used are aluminum foil having a thickness in the range from 30 to 60 micrometers coated with a layer of polypropylene or a polypropylene/vinyl lacquer.

the beverage packages of the present invention may contain, for example, leaf tea or roast and ground coffee as the beverage preparation ingredient. A beverage is prepared from the beverage package by means of a brewing machine and it is preferred that the outlet aperture is formed in the beverage package during the brewing cycle.

The outlet aperture of the package may alternatively be sealed by a peel-off tab or strip which is removed by the consumer prior to the preparation of a beverage from the package.

Figure 2:
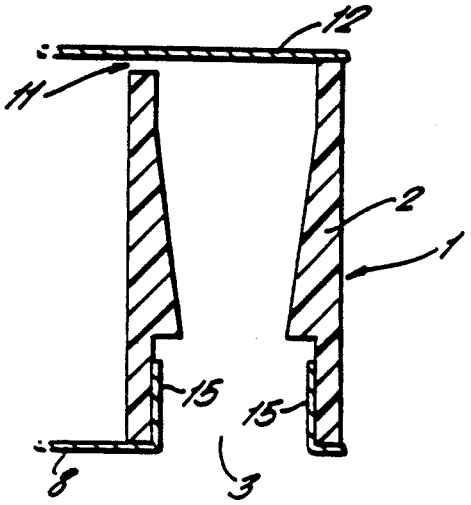
Figure 3:
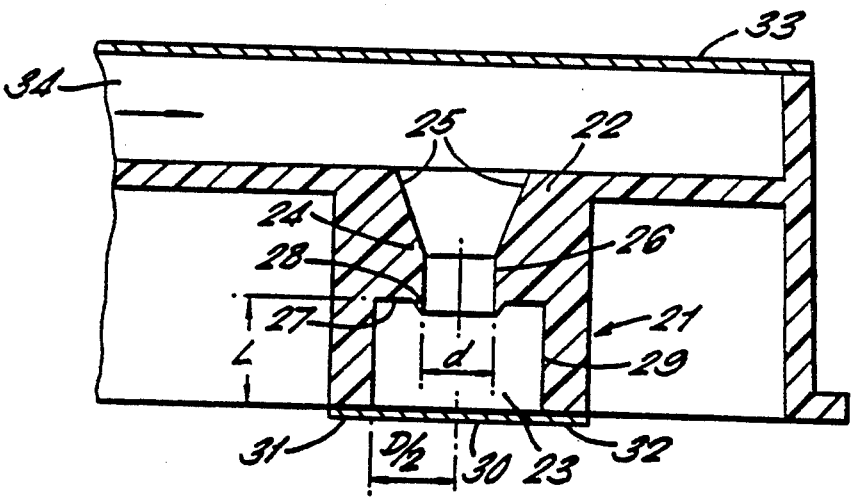
Figure 4:
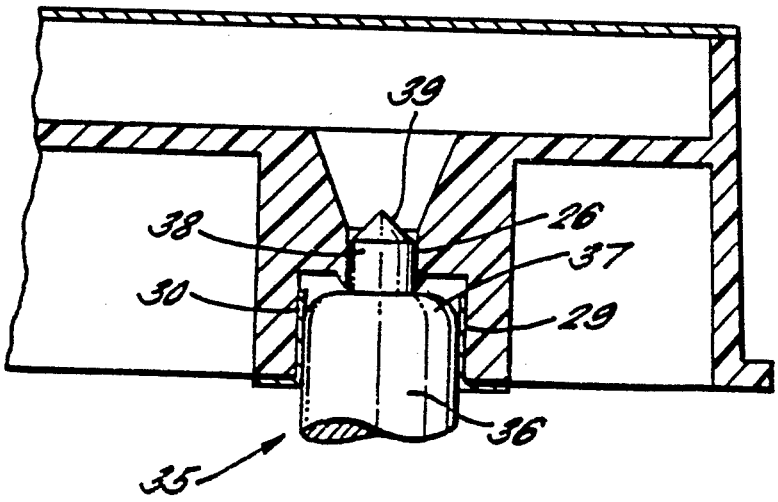

The present invention will be further described with reference to the accompanying drawings, in which:

FIG. 1 is a schematic section through a nozzle of a sealed beverage package;

FIG. 2. is a view of the nozzle of FIG. 1 during the preparation of a beverage therefrom;

FIG. 3. is a schematic section through an alternative nozzle of a sealed beverage package; and FIG. 4 is a view of the nozzle of FIG. 3 whilst the outlet aperature is being punctured.

Referring to FIGS. 1 and 2 of the drawings, the outlet only of a beverage package is shown schematically. The nozzle is shown generally at 1 and has a body portion 2 and an outlet aperture 3. The body portion has a converging throat 4, the walls 5 of the throat being inclined at an angle of approximately 5° to the vertical. The throat 4 terminates in a shoulder 6. A bore 7 extends from shoulder 6 to the outlet aperture 3. The outlet aperture 3 is sealed by an aluminium foil seal 8 which seals at points 9 and 10 around the periphery thereof. The rest of the beverage package extends generally to the left of the nozzle and is not depicted on the drawings. The nozzle 1 communicates with the beverage package through a channel shown at 11 through which the beverage produced from the package is caused to flow. The top of the beverage package is shown at 12 as a layer of aluminium foil.

During the preparation of a beverage from the package the foil sealed over the outlet aperture 3 of the package is ruptured, for example by a needle (not shown). The aluminium foil 8 is thus punctured and its broken edges are turned inwardly by the shank of the needle to lie neatly within the bore of the nozzle as shown at 15. It will be appreciated that the folded portions 15 of the aluminium foil do not obstruct the outlet aperture 3 of the package and this enables the beverage to flow, at the appropriate stage in the brewing cycle, out of the package without catching on the ruptured edge of the foil. As shown in FIG. 1 the length, L, of the bore is greater than one half of the diameter, D of the outlet aperature 3.

Referring to FIG. 3 and 4, the outlet of a sealed beverage package is shown schematically in these drawings. The nozzle is shown generally at 21 and has a body portion 22 and an outlet aperture 23. The body has a throat 24 which has converging walls 25 which join a bore 26. The bore 26 of the throat terminates in a shoulder 27 which is provided, adjacent the outlet of the bore 26, with a drip lip 28. The walls 25 of the throat are inclined at an angle of approximately 15° to 30° to the vertical. A second larger bore 29 extends from shoulder 29 to the outlet aperture 23. The outlet aperture 23 is sealed by a coated aluminium foil laminate 30 which seals at points 31 and 32 around the periphery thereof. The beverage package has a flexible top 33 formed from a coated laminate material. The major portion of the beverage package extends generally to the left of the nozzle and is not shown in the drawings. The nozzle 21 communicates with the beverage package via an outlet channel through which the beverage produced from the package is caused to flow in the direction of the arrow.

During the preparation of a beverage from the package the outlet aperture 23 of the package is ruptured by a needle 35. The needle has a shank 36 which is adapted to be a sliding fit in the bore 29 of the nozzle, allowing for two thicknesses of the foil laminate 30. The shank 36 has a rounded shoulder 37 which has a piercing shaft 38 mounted thereon. The piercing shaft 38 has a smaller diameter than the diameter of the shank 36 and is adapted to fit loosely in the bore 26 of the throat 24. The shaft 38 terminates in a conical point 39.

The outlet to the beverage package is formed by the conical point 39 of the needle piercing the aluminium foil laminate 30. The foil laminate will tear in several directions as the needle moves upwards in the bore 29. The shoulder 37 of the needle continues to tear the foil laminate into leaves until the shank 36 causes the leaves of the foil laminate 30 to lie neatly within the bore 29 of the nozzle.

Whilst the ratio of the diameter, d, of the bore 26 of the throat 24 to the diameter, d, of the bore 29 is not critical, it is preferred that it is about half, i.e. $D \approx 2d$.

Whilst the nozzle which has been described herein can be used in many types of beverage packages containing one or more beverages ingredients, it is particularly adapted for incorporation in a beverage package of the type as described and claimed in our co-pending European Patent Application No. 87311325.2.

We claim:

1. A sealed beverage package containing one or more beverage preparation ingredients and being formed from substantially air- and water-impermeable materials, said package having a nozzle formed therein which comprises an outlet aperature and a body, said body having a throat portion, said throat portion having side walls which converge at least along part of the length thereof; a cylindrical bore, beginning at the point where said throat terminates, extending to said outlet aperature said cylindrical bore terminating adjacent a shoulder, said shoulder also lies within the outlet aperature; a drip lip for avoiding dripping of said beverage, on said shoulder being adjacent to the outlet of said bore; and said outlet aperature having the width or diameter, D, and the length of the bore of the nozzle, L, being related by the following equation:

$$L \geqq D/2$$

wherein the outlet aperature is sealed by a rupturable seal of aluminium foil or a laminated material which has appropriate deadfold characteristics so that on rupturing the seal to form an outlet from the package it will remain folded in the bore of the nozzle.

2. A package as claimed in claim 1 wherein the diameter of the throat at the point where it terminates in the shoulder, is about one half of the width or diameter of the outlet aperture.

3. A package as claimed in claim 1 wherein the throat portion has walls with coverage along all of the length thereof.

* * * * *